US008991099B1

(12) United States Patent
Erskine

(10) Patent No.: US 8,991,099 B1
(45) Date of Patent: Mar. 31, 2015

(54) DOUBLE ACTING PATIO DOOR

(71) Applicant: Taylor Made Group, LLC, Gloversville, NY (US)

(72) Inventor: Edward J. Erskine, Benson, NY (US)

(73) Assignee: Taylor Made Group, LLC, Gloversville, NY (US)

( * ) Notice: Subject to any disclaimer, the term of this patent is extended or adjusted under 35 U.S.C. 154(b) by 46 days.

(21) Appl. No.: 14/026,529

(22) Filed: Sep. 13, 2013

(51) Int. Cl.

| | |
|---|---|
| ***E06B 3/46*** | (2006.01) |
| ***E05D 15/50*** | (2006.01) |
| ***E05D 7/00*** | (2006.01) |
| *E05D 15/48* | (2006.01) |
| *E05D 15/58* | (2006.01) |

(52) U.S. Cl.

CPC ..... *E06B 3/469* (2013.01); *E06B 3/4636* (2013.01); *E05D 15/50* (2013.01); *E05D 7/00* (2013.01); *E05D 2015/485* (2013.01); *E05D 2015/586* (2013.01)

USPC ..... 49/127

(58) Field of Classification Search

CPC ..... E06B 3/469; E06B 3/4636; E05D 15/50; E05D 7/00; E05D 2015/586; E05D 2015/485; E05D 15/58; E05D 15/48; E05Y 2900/132; E05Y 2800/122

USPC ..... 49/105, 127, 179, 181, 188, 194, 196, 49/404, 406, 453–456

See application file for complete search history.

(56) References Cited

U.S. PATENT DOCUMENTS

| | | | | |
|---|---|---|---|---|
| 1,429,833 | A * | 9/1922 | Beall | 160/90 |
| 1,852,608 | A * | 4/1932 | Grable | 160/211 |
| 1,934,299 | A * | 11/1933 | Fairhurst | 49/127 |
| 2,052,089 | A * | 8/1936 | Fairhurst | 49/127 |
| 2,466,913 | A * | 4/1949 | Rogers | 160/224 |
| 2,895,183 | A * | 7/1959 | Dumbolton | 160/197 |
| 3,460,290 | A | 8/1969 | Wutzke | |
| 4,619,074 | A | 10/1986 | Leung et al. | |
| 5,005,315 | A | 4/1991 | Jackson, Jr. | |
| 5,749,172 | A * | 5/1998 | Isopahkala | 49/127 |
| 6,276,092 | B1 | 8/2001 | Neo | |
| 6,422,287 | B1 | 7/2002 | Wilke | |
| 6,990,771 | B2 | 1/2006 | Pfaff | |
| 7,451,802 | B2 | 11/2008 | Cianciolo et al. | |
| 7,458,410 | B1 * | 12/2008 | Bronner | 160/197 |
| 7,685,774 | B2 | 3/2010 | Thielmann | |
| 7,950,439 | B2 * | 5/2011 | Anderson | 160/211 |
| 8,096,342 | B2 * | 1/2012 | Scruggs | 160/211 |
| 8,443,549 | B2 * | 5/2013 | Salvietti et al. | 49/141 |
| 8,627,604 | B2 * | 1/2014 | Seymour et al. | 49/141 |
| 2014/0352220 | A1 * | 12/2014 | Rees | 49/164 |

* cited by examiner

*Primary Examiner* — Katherine Mitchell
*Assistant Examiner* — Justin Rephann
(74) *Attorney, Agent, or Firm* — Nixon & Vanderhye P.C.

(57) ABSTRACT

A multi-panel door assembly is arrangeable into multiple configurations. The multi-panel door assembly includes at least three panel positions, including a first side position, a second side position, and a center position between the first and second side positions, and a corresponding at least three door panels. A fixed door panel is fixed in the first side position, and a secondary door panel is displaceable between the first side position and the second side position. A swinging door jamb is selectively displaceable between an engaged position where the primary door panel is displaceable between the center position and the second side position, and a disengaged position, where the primary door panel is displaceable between the first side position and the second side position.

20 Claims, 7 Drawing Sheets

DOUBLE ACTING PATIO DOOR

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The invention relates to a patio door assembly and, more particularly, to a multi-panel door assembly that is selectively arrangeable into multiple configurations.

Sliding glass doors are typically constructed with two door panels supported in a frame where one of the two panels is slidable into an overlaying position relative to the other panel to open the doors. The size of the opening is typically limited to the size of the sliding panel.

It would be desirable to provide for selective configurations of a door assembly so that an opening for the door assembly can be made larger than the normal opening for entertaining or other purposes.

BRIEF SUMMARY OF THE INVENTION

A multi-panel door assembly includes at least three panels that are selectively configurable into multiple orientations. In one orientation, the primary door may be displaceable between a normal closed position and a normal open position. By virtue of a swinging door jamb, the door panels can be overlaid on one another to provide a larger "party" opening.

In an exemplary embodiment, a door assembly includes a first fixed door jamb including at least three panel landings, and a second fixed door jamb including at least two panel landings generally aligned with and opposed to a corresponding at least two of the panel landings of the first fixed door jamb. Two panel tracks extend between the first fixed door jamb and the second fixed door jamb. A fixed door panel is secured in one of the at least three panel landings of the first fixed door jamb, and two movable door panels are cooperable with the two panel tracks, respectively, and the two movable door panels include a primary door panel and a secondary door panel. A swinging door jamb is selectively displaceable between an engaged position, in which the swinging door jamb is positioned between a facing pair of the first fixed door jamb panel landings and the second fixed door jamb panel landings, and a disengaged position, in which the swinging door jamb is clear of the facing pair of panel landings. The two movable door panels are selectively positionable between the first fixed door jamb and the second fixed door jamb.

The first fixed door jamb, the second fixed door jamb, and the swinging door jamb may define three panel positions including a first side position, a center position, and a second side position, where the fixed door panel is fixed in the first side position. In this context, with the swinging door jamb in the engaged position, the primary door panel may be displaceable between the center position and the second side position. With the swinging door jamb in the disengaged position, the primary door panel may be displaceable between the first side position and the second side position. The secondary door panel may be displaceable between the first side position and the second side position.

With the swinging door jamb in the engaged position, the door assembly may be closed by positioning the primary door panel in the center position and by positioning the secondary door panel in the second side position. With the swinging door jamb in the disengaged position, the door assembly may be arrangeable into a party configuration with each of the fixed door panel, the primary door panel, and the secondary door panel in the first side position.

The two movable door panels may include panel connectors that are engageable with each other to define a sealed connection. In this context, the panel connectors may define the sealed connection when the door assembly is in a closed configuration.

In one arrangement, the swinging door jamb is coupled with the fixed door panel.

The first fixed door jamb and the second fixed door jamb may be identical.

The swinging door jamb may be displaceable from the engaged position to the disengaged position across 90°.

In another exemplary embodiment, a multi-panel door assembly is arrangeable into multiple configurations. The multi-panel door assembly includes at least three panel positions, including a first side position, a second side position, and a center position between the first and second side positions, and a corresponding at least three door panels including a fixed door panel, a primary door panel, and a secondary door panel. The fixed door panel is fixed in the first side position, and the secondary door panel is displaceable between the first side position and the second side position. A swinging door jamb is selectively displaceable between an engaged position, in which the swinging door jamb is positioned in a displacement path of the primary door panel such that the primary door panel is displaceable between the center position and the second side position, and a disengaged position, in which the swinging door jamb is clear of the displacement path and the primary door panel is displaceable between the first side position and the second side position.

In another exemplary embodiment, a method of arranging the multi-panel door assembly of the preferred embodiments from a closed configuration in which the swinging jamb is in the engaged position, in which the primary door panel is in the center position, and in which the secondary door panel is locked in the second side position, to a party configuration, includes the steps of sliding the primary door panel from the center position to the second side position; displacing the swinging door jamb from the engaged position to the disengaged position; unlocking the secondary door panel; and sliding the primary door panel and the secondary door panel to the first side position.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
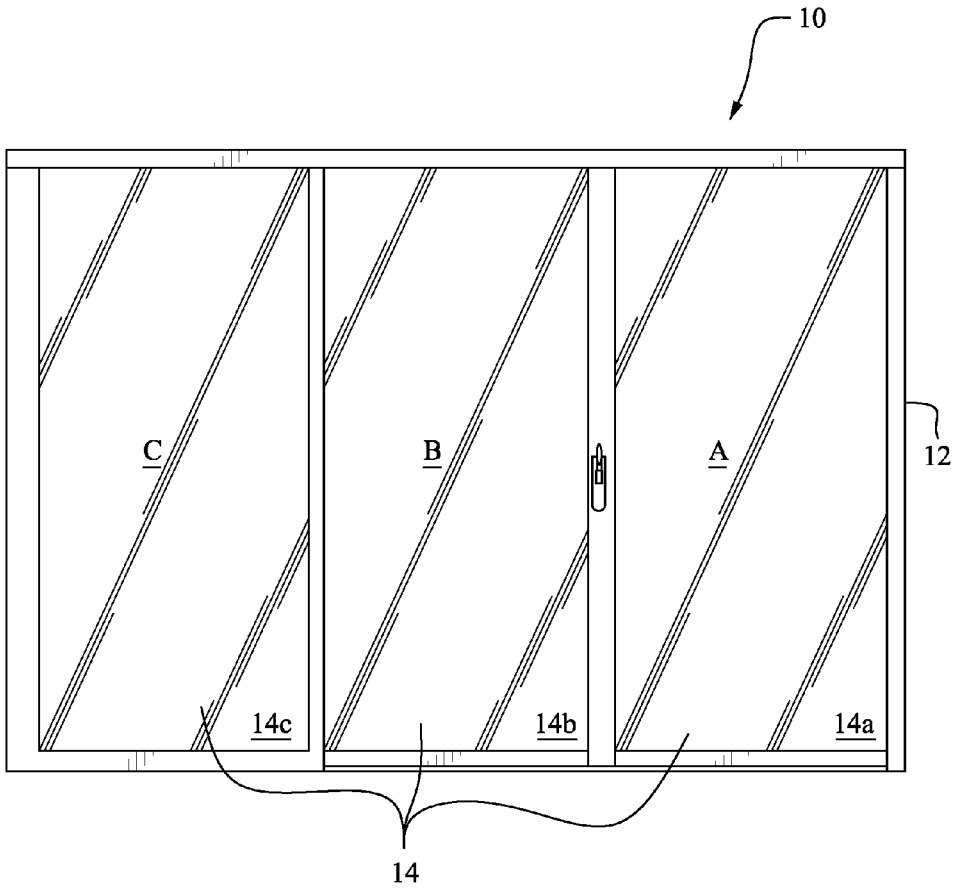
FIG. 1 shows the door assembly in a closed configuration.
Figure 2:
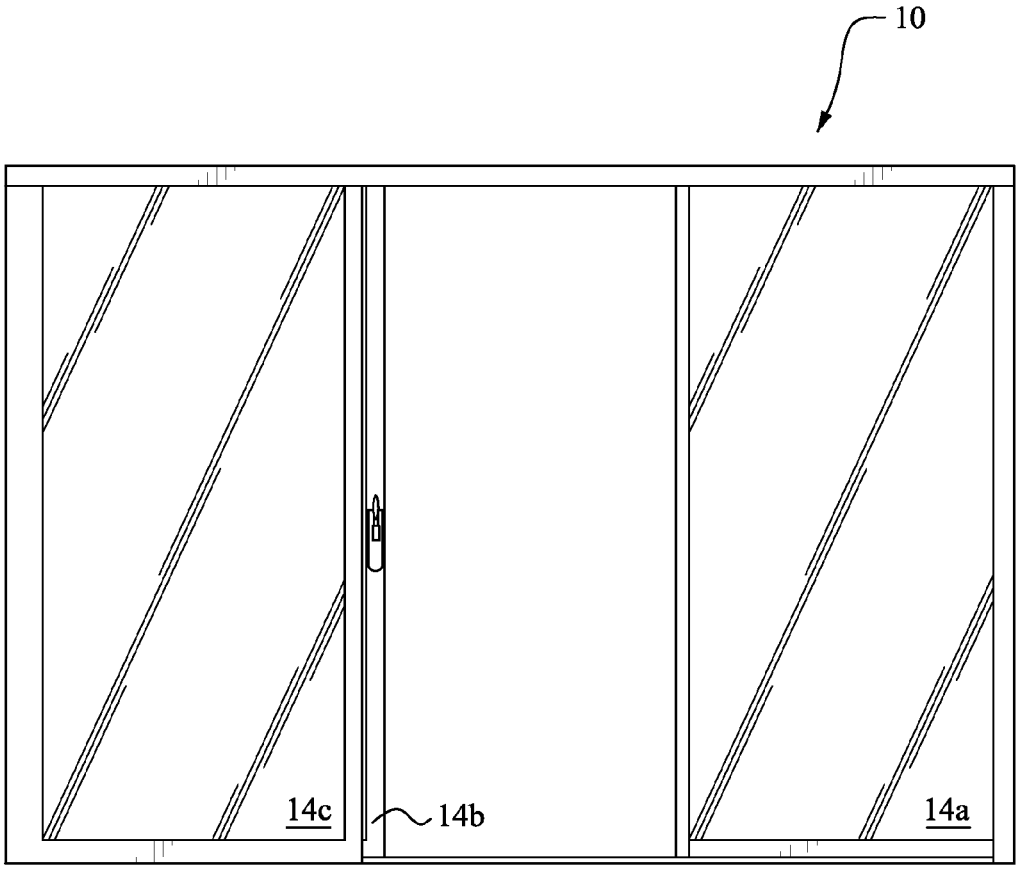
FIG. 2 shows the door assembly in a normal open configuration.
Figure 3:
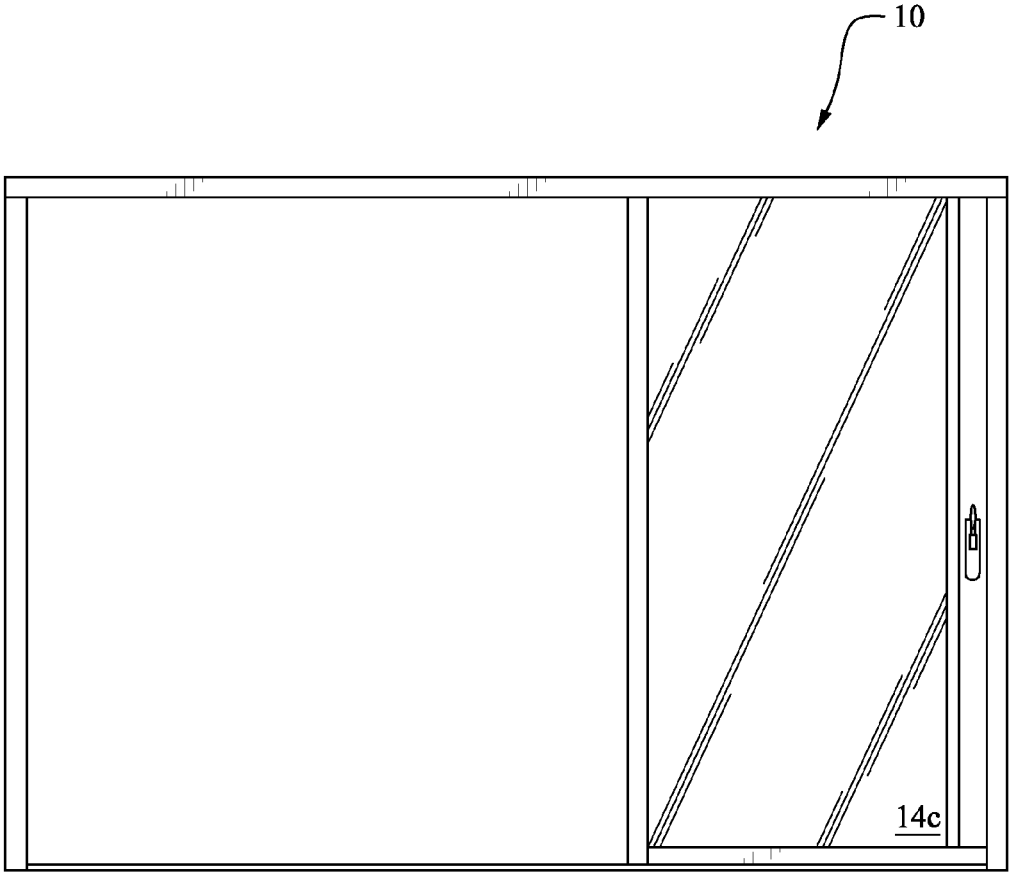
FIG. 3 shows the door assembly in a "party" configuration.

FIGS. 1-3 show the door assembly 10 according to preferred embodiments of the invention in various configurations. The door assembly 10 includes a door frame 12 and at least three door panels 14 supported in the frame 12. The door panels 14 can be defined as a fixed door panel 14*a*, a main or primary door panel 14*b* and a secondary door panel 14*c*. The assembly defines three panel positions including a first side position A (or C), a center position B, and a second side position C (or A). FIG. 1 shows the door assembly in a closed configuration where the door panels 14*a*, 14*b*, 14*c* are respectfully positioned in the first side position A, the center position B, and the second side position C.

As will be discussed in more detail below, the door assembly 10 is selectively arrangeable into multiple configurations. FIG. 2 shows a normal open configuration where the primary door panel 14*b* overlays the secondary door panel 14*c* in the second side position C. The fixed door panel 14*a* is fixed in the first side position A. FIG. 3 shows the door assembly 10 arranged in to a party configuration with each of the fixed door panel 14*a*, the primary door panel 14*b*, and the secondary door panel 14*c* overlaid in the first side position A.

Figure 4:
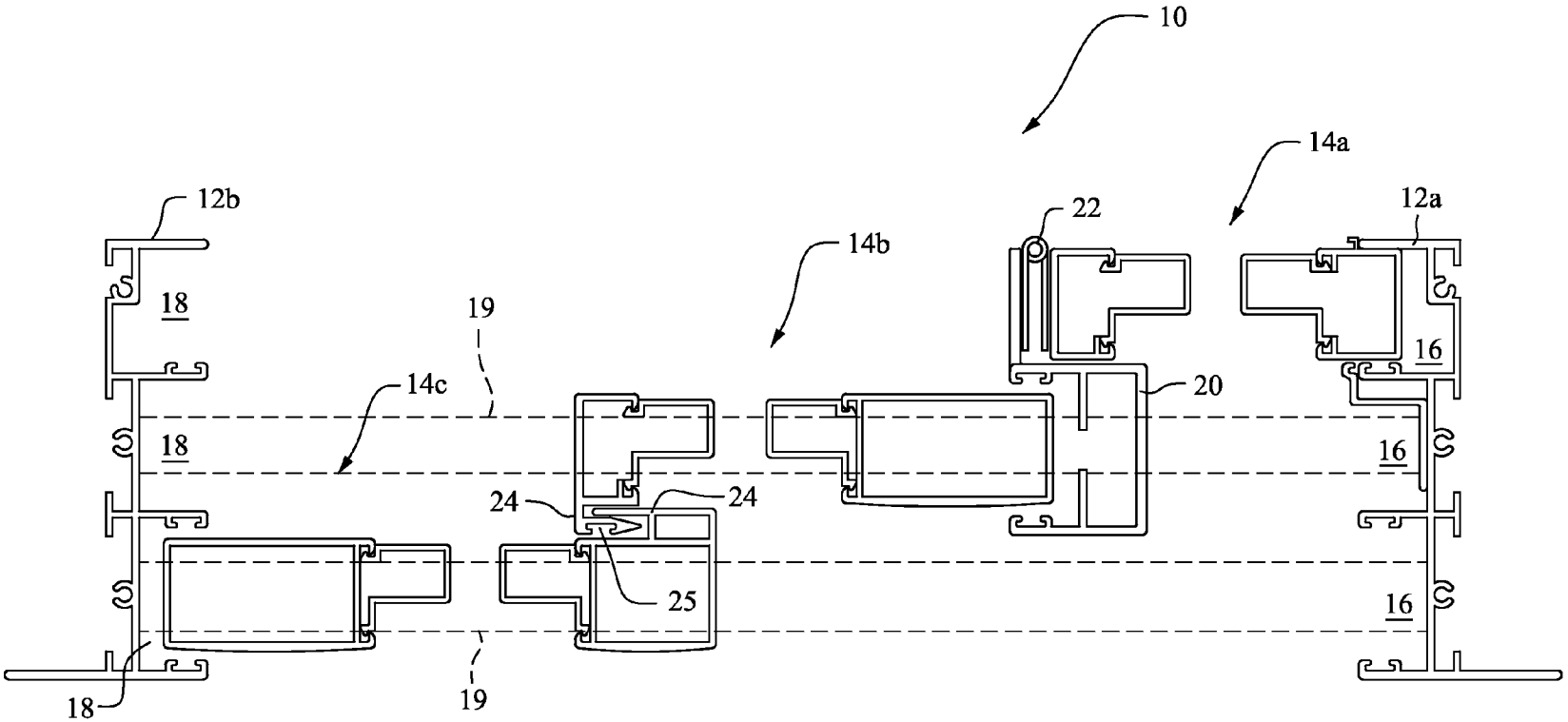
FIG. 4 is a plan view of the door assembly configured for a normal opening/passageway.
Figure 5:
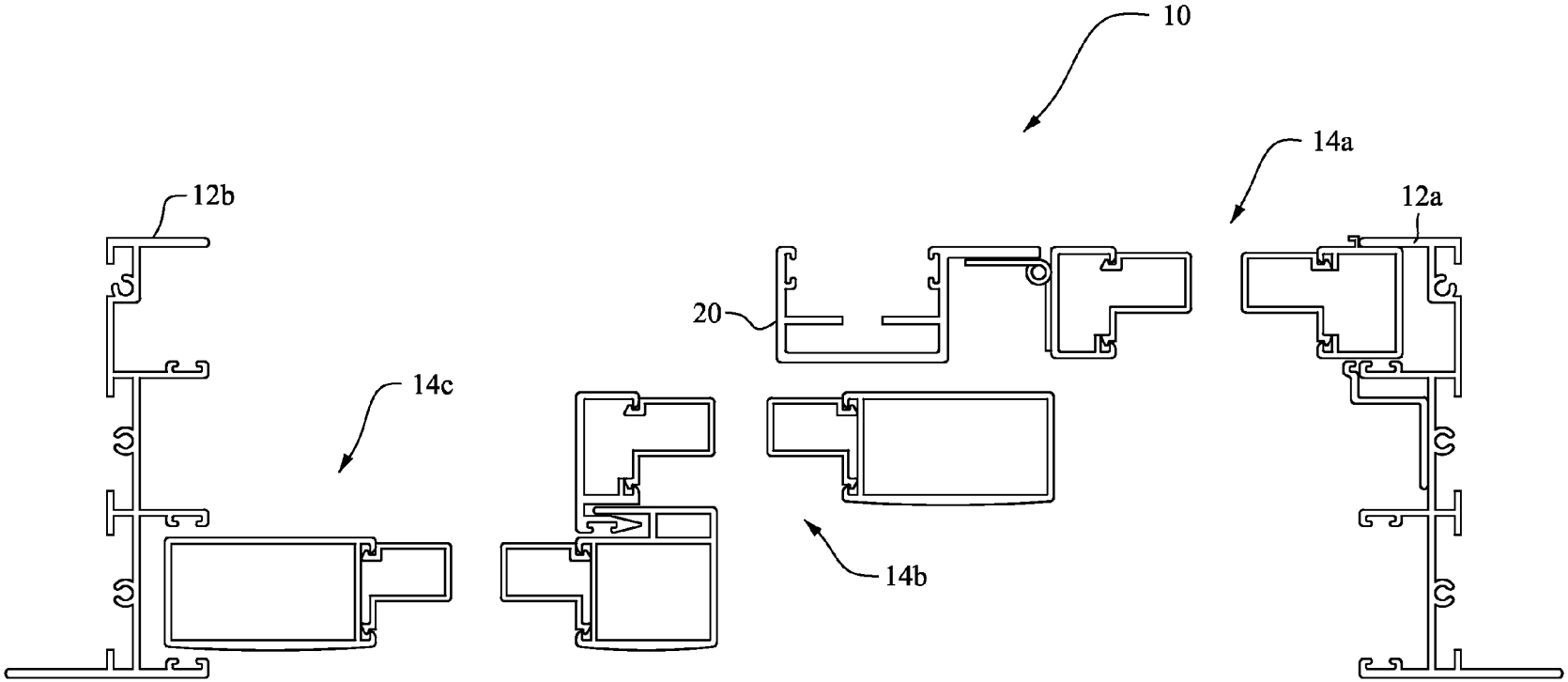
FIG. 5 shows the door assembly in a configuration in which the door panels can be overlaid into the "party" configuration.
Figure 6:
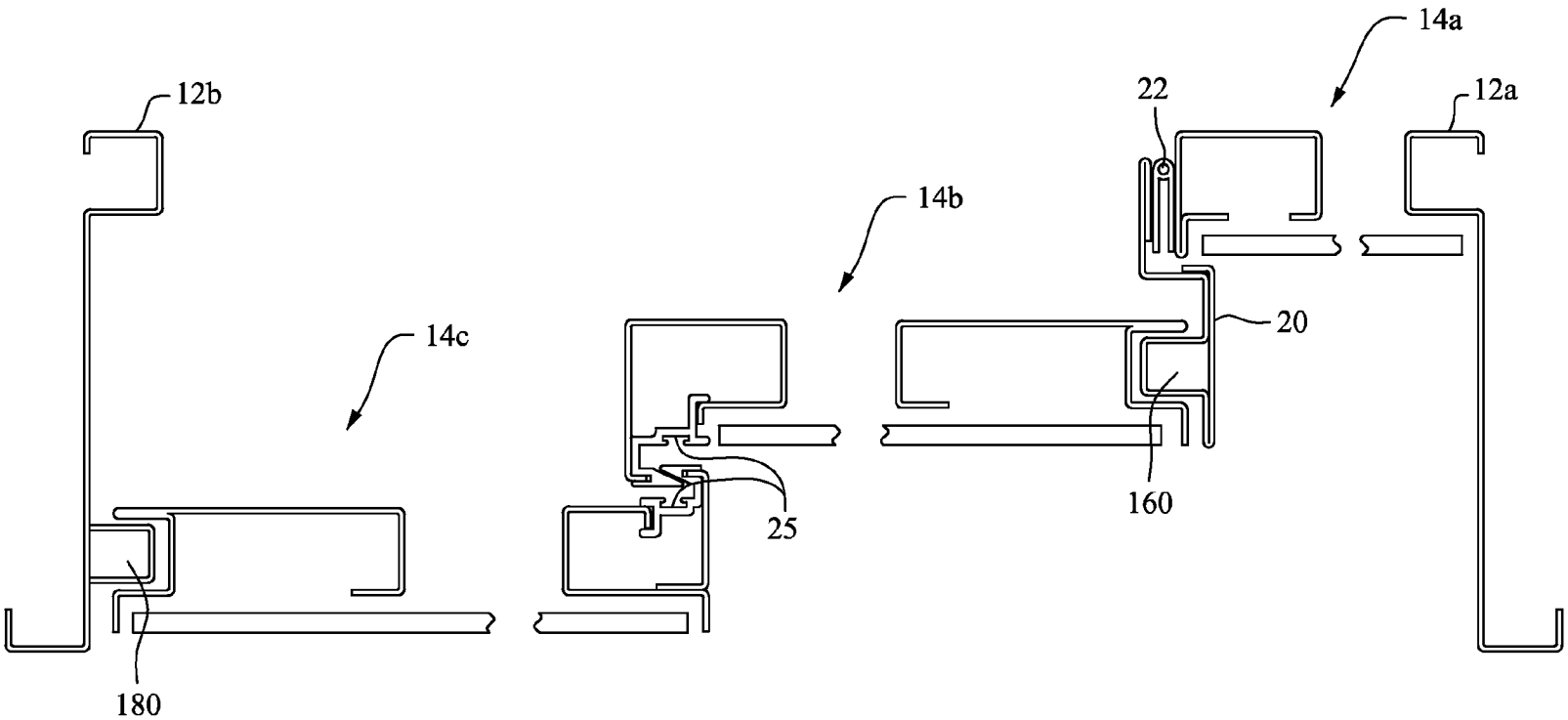
FIG. 6 is a stainless steel version with alternative landings for the door panels.

FIGS. 4 and 5 are top sectional views of the door assembly 10. The door frame 12 includes a first fixed door jamb 12*a* including at least three panel landings or channels 16 and a second fixed door jamb 12*b* including at least two panel landings or channels 18 that are generally aligned with and opposed to a corresponding at least two of the panel channels 16 of the first fixed door jamb 12*a*. The landings or channels 16, 18 may be structured in any suitable configuration. For example, the landings may be structured into the channel structures shown in FIGS. 4 and 5. Alternatively, the landings may comprise a flat surface with a suitable seal. In still another alternative construction, with reference to FIG. 6, the landings may comprise posts 160, 180 on which the door panels 14*b*, 14*c* engage. In a preferred construction, the first fixed door jamb 12*a* and the second fixed door jamb 12*b* are identical and arranged in a mirrored orientation. As such, the second fixed door jamb 12*b* may include a third panel landing 18, which may not be used.

At least the main door panel 14*b* and the secondary door panel 14*c* are movable on corresponding panel tracks 19 (shown schematically in FIG. 4) that extend between the first fixed door jamb 12*a* and the second fixed door jamb 12*b*. In a preferred construction, the fixed door panel 14*a* is fixedly secured (i.e., not intended for sliding displacement) in one of the panel channels 16 of the first fixed door jamb 12*a*. The fixed door panel 14*a* may be configured as a fixed pane, window or other structure. Additionally, the fixed door panel 14*a* may be welded as part of the first fixed door jamb 12*a*.

The assembly also includes a moveable or swinging door jamb 20 that is selectively displaceable between an engaged position (FIG. 4), in which the swinging door jamb 20 is positioned between a facing pair of the first fixed door jamb panel landings 16 and the second fixed door jamb panel landings 18, and a disengaged position (FIG. 5), in which the swinging door jamb 20 is clear of the facing pair of panel landings 16, 18. In the various configurations, the two movable door panels 14*b*, 14*c* are selectively positionable between the first fixed door jamb 12*a* and the second fixed door jamb 12*b*. Use of the term "swinging" is intended to encompass any positional change of the door jamb, including, without limitation, a sliding jamb, a removable jamb, a shifting jamb or any other displacement of the jamb 20 into or out of the path of a movable door panel.

In the engaged position shown in FIG. 4, the swinging door jamb 20 is positioned to receive the main door panel 14*b* in the center position B via a swinging jamb landing 21. With the swinging door jamb 20 in the engaged position, the door assembly 10 is closed by positioning the primary door panel 14*b* in the center position B and by positioning the secondary door panel 14*c* in the second side position C. The secondary door panel 14*c* can be locked in the corresponding panel channel 18 of the second fixed door jamb 12*b* with conventional structure. With the swinging door jamb 20 in the engaged position, the main door panel 14*b* is displaceable between the center position B (closed) and the second side position C (open). As shown, the swinging door jamb 20 may be coupled with/adjacent the fixed door panel 14*a* via a hinge 22. The swinging door jamb 20 is displaceable from the engaged position (FIG. 4) to the disengaged position (FIG. 5) across 90°.

With reference to FIG. 5, with the swinging door jamb 20 in the disengaged position, the primary door panel 14*b* is displaceable between the first side position A and the second side position C. Additionally, the secondary door panel 14*c* is displaceable between the first side position A and the second side position C. With the swinging door jamb 20 in the disengaged position, the door assembly 10 is arrangeable into the party configuration shown in FIG. 3 with each of the fixed door panel 14*a*, the main door panel 14*b*, and the secondary door panel 14*c* overlaid in the first side position A.

Preferably, the two movable door panels 14*b*, 14*c* include panel connectors 24 that are engageable with each other to define a sealed connection. Specifically, the panel connectors 24 define the sealed connection when the door assembly 10 is in the closed configuration. One or both of the panel connectors 24 may include a seal housing 25 for supporting a sealing member.

In order to orient the door assembly into the party configuration shown in FIG. 3 from the closed configuration shown in FIG. 1, the primary door panel 14*b* can be slid from the center position B to the second side position C. Subsequently, the swinging jamb 20 can be displaced from the engaged position (FIG. 4) to the disengaged position (FIG. 5). After unlocking the secondary door panel 14*c*, the primary door panel 14*b* and the secondary door panel 14*c* can be slid to the first side position A. In order to rearrange the door assembly to the closed position shown in FIG. 1, these steps are reversed.

Figure 7:
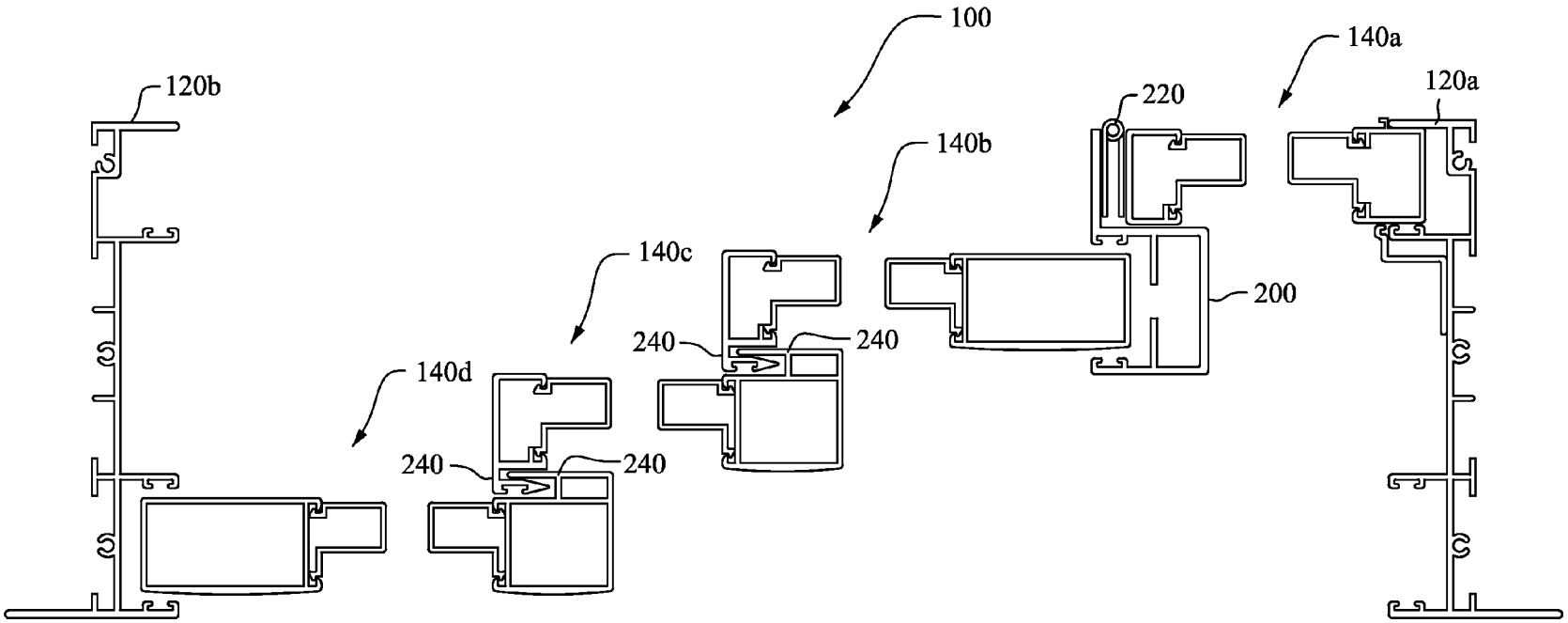
FIG. 7 shows an alternative embodiment utilizing four door panels.

Although the door assembly 10 is shown with the three door panels 14 including the fixed door panel 14*a*, the primary door panel 14*b*, and the secondary door panel 14*c*, the invention is not meant to be limited to a three-panel arrangement. The assembly may alternatively include four or more door panels. FIG. 7 shows an exemplary door assembly 100 with four door panels, including a fixed door panel 140*a*, a primary door panel 140*b*, and two secondary door panels 140*c*, 140*d*. The fixed door jambs 120*a*, 120*b* are sized to accommodate the four door panels 140. The swinging door jamb 200 is secured adjacent the fixed door panel 140*a* via a hinge 220. Panel connectors are disposed between the primary door panel 140*b* and the corresponding secondary door panel 140*c* as well as between the secondary door panels 140*c*, 140*d*.

The door assembly of the preferred embodiments provides a multi-panel door assembly that can be arranged in multiple configurations. The swinging door jamb in its engaged position provides for normal use with the primary door panel displaceable between opened and closed positions. By displacing the swinging door jamb to its disengaged position, the door assembly can be easily configured into a party configuration with all door panels stacked to the side and a wider opening for ingress and egress.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A door assembly comprising:

a first fixed door jamb including at least three panel landings;

a second fixed door jamb including at least two panel landings generally aligned with and opposed to a corresponding at least two of the panel landings of the first fixed door jamb;

two panel tracks extending between the first fixed door jamb and the second fixed door jamb;

a fixed door panel secured in one of the at least three panel landings of the first fixed door jamb;

two movable door panels cooperable with the two panel tracks, respectively, the two movable door panels including a primary door panel and a secondary door panel; and a swinging door jamb selectively displaceable between an engaged position, in which the swinging door jamb is positioned between a facing pair of the first fixed door jamb panel landings and the second fixed door jamb panel landings, and a disengaged position, in which the swinging door jamb is clear of the facing pair of panel landings, wherein the two movable door panels are selectively positionable between the first fixed door jamb and the second fixed door jamb.

2. A door assembly according to claim 1, wherein the first fixed door jamb, the second fixed door jamb, and the swinging door jamb define three panel positions including a first side position, a center position, and a second side position, and wherein the fixed door panel is fixed in the first side position.

3. A door assembly according to claim 2, wherein with the swinging door jamb in the engaged position, the primary door panel is displaceable between the center position and the second side position.

4. A door assembly according to claim 3, wherein with the swinging door jamb in the disengaged position, the primary door panel is displaceable between the first side position and the second side position.

5. A door assembly according to claim 4, wherein the secondary door panel is displaceable between the first side position and the second side position.

6. A door assembly according to claim 2, wherein with the swinging door jamb in the engaged position, the door assembly is closed by positioning the primary door panel in the center position and by positioning the secondary door panel in the second side position.

7. A door assembly according to claim 2, wherein with the swinging door jamb in the disengaged position, the door assembly is arrangeable into a party configuration with each of the fixed door panel, the primary door panel, and the secondary door panel in the first side position.

8. A door assembly according to claim 1, wherein the two movable door panels comprise panel connectors that are engageable with each other to define a sealed connection.

9. A door assembly according to claim 8, wherein the panel connectors define the sealed connection when the door assembly is in a closed configuration.

10. A door assembly according to claim 1, wherein the swinging door jamb is coupled with the fixed door panel.

11. A door assembly according to claim 1, wherein the first fixed door jamb and the second fixed door jamb are identical.

12. A door assembly according to claim 1, wherein the swinging door jamb is displaceable from the engaged position to the disengaged position across 90°.

13. A multi-panel door assembly that is arrangeable into multiple configurations, the multi-panel door assembly comprising:

at least three panel positions, including a first side position, a second side position, and a center position between the first and second side positions;

a corresponding at least three door panels including a fixed door panel, a primary door panel, and a secondary door panel, wherein the fixed door panel is fixed in the first side position, and wherein the secondary door panel is displaceable between the first side position and the second side position; and a swinging door jamb selectively displaceable between an engaged position, in which the swinging door jamb is positioned in a displacement path of the primary door panel such that the primary door panel is displaceable between the center position and the second side position, and a disengaged position, in which the swinging door jamb is clear of the displacement path and the primary door panel is displaceable between the first side position and the second side position.

14. A multi-panel door assembly according to claim 13, wherein with the swinging door jamb in the engaged position, the multi-panel door assembly is closed with the primary door panel in the center position and with the secondary door panel in the second side position.

15. A multi-panel door assembly according to claim 13, wherein with the swinging door jamb in the disengaged position, the multi-panel door assembly is arrangeable into a party configuration with each of the fixed door panel, the primary door panel, and the secondary door panel in the first side position.

16. A multi-panel door assembly according to claim 13, wherein the primary door panel and the secondary door panel comprise panel connectors that are engageable with each other to define a sealed connection.

17. A multi-panel door assembly according to claim 16, wherein the panel connectors define the sealed connection when the multi-panel door assembly is in a closed configuration.

18. A multi-panel door assembly according to claim 13, wherein the swinging door jamb is coupled with the fixed door panel.

19. A multi-panel door assembly according to claim 13, wherein the swinging door jamb is displaceable from the engaged position to the disengaged position across 90°.

20. A method of arranging the multi-panel door assembly of claim 13 from a closed configuration in which the swinging jamb is in the engaged position, in which the primary door panel is in the center position, and in which the secondary door panel is locked in the second side position, to a party configuration, the method comprising:

sliding the primary door panel from the center position to the second side position;

displacing the swinging door jamb from the engaged position to the disengaged position;

unlocking the secondary door panel; and sliding the primary door panel and the secondary door panel to the first side position.

* * * * *